US008234917B2

(12) United States Patent
Burkhart et al.

(10) Patent No.: US 8,234,917 B2
(45) Date of Patent: Aug. 7, 2012

(54) DEVICE AND METHOD FOR ERROR MONITORING FOR UNDERCARRIAGE COMPONENTS OF RAIL VEHICLES

(75) Inventors: Thomas Burkhart, München (DE); Ulf Friesen, Neubiberg (DE)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 422 days.

(21) Appl. No.: 12/598,796

(22) PCT Filed: May 16, 2008

(86) PCT No.: PCT/EP2008/003954

§ 371 (c)(1),
(2), (4) Date: Nov. 4, 2009

(87) PCT Pub. No.: WO2008/141775

PCT Pub. Date: Nov. 27, 2008

(65) Prior Publication Data

US 2010/0078527 A1 Apr. 1, 2010

(30) Foreign Application Priority Data

May 22, 2007 (DE) ..... 10 2007 024 065

(51) Int. Cl.
*G01M 17/08* (2006.01)

(52) U.S. Cl. ..... 73/117.03; 73/11.08

(58) Field of Classification Search ..... 73/11.06, 73/11.07, 11.08, 117.01, 117.03
See application file for complete search history.

(56) References Cited

U.S. PATENT DOCUMENTS

| | | | | |
|---|---|---|---|---|
| 5,203,089 | A | 4/1993 | Trefouel et al. | |
| 6,008,731 | A * | 12/1999 | Capan | 340/665 |
| 6,087,950 | A * | 7/2000 | Capan | 340/665 |
| 6,539,293 | B2 * | 3/2003 | Bachtiger et al. | 701/20 |
| 7,081,824 | B2 * | 7/2006 | Gilbert | 340/686.2 |
| 2004/0173033 | A1 * | 9/2004 | Gilbert | 73/862 |
| 2006/0176162 | A1 | 8/2006 | Miekley et al. | |
| 2008/0156944 | A1 | 7/2008 | Aurich et al. | |

FOREIGN PATENT DOCUMENTS

DE 199 53 677 C1 6/2001

(Continued)

OTHER PUBLICATIONS

English Translation of the International Preliminary Report on Patentability dated Dec. 3, 2009 for International Application No. PCT/EP2008/003954.

(Continued)

*Primary Examiner* — Eric S McCall

(57) ABSTRACT

The invention relates to a device for monitoring errors in undercarriage components of rail vehicles, having at least one acceleration sensor which works with an evaluation unit. At least one acceleration sensor is arranged on the undercarriage of the rail vehicle in such a manner that its direction of detection has at least one component parallel to the vertical axis (z-direction) of the rail vehicle. The invention proposes that the acceleration sensor is constructed in such a manner that it delivers a measuring signal which contains the signal portion corresponding to a ground acceleration, or represents a signal corresponding to a ground acceleration, and that the evaluation unit has a routine for testing functions of the acceleration sensor, the routine controlling an error signal if the measuring signal delivered by the acceleration sensor contains no signal portion corresponding to a ground acceleration. The routine also suppresses the error signal if this is not the case.

15 Claims, 5 Drawing Sheets

FOREIGN PATENT DOCUMENTS

| | | | |
|---|---|---|---|
| DE | 101 45 433 | A1 | 4/2002 |
| DE | 101 61 283 | B4 | 8/2002 |
| DE | 600 02 450 | T2 | 4/2004 |
| DE | 10 2005 002 239 | A1 | 7/2006 |
| DE | 10 2005 010 118 | A | 9/2008 |
| EP | 0 461 628 | A1 | 12/1991 |
| EP | 1 317 369 | B1 | 6/2003 |
| EP | 1 343 676 | B1 | 9/2003 |
| GB | 1 517 513 | | 7/1978 |
| WO | WO 00/51869 | | 9/2000 |

OTHER PUBLICATIONS

International Search Report for International Application No. PCT/EP2008/003954, dated Aug. 21, 2008.

* cited by examiner

DEVICE AND METHOD FOR ERROR MONITORING FOR UNDERCARRIAGE COMPONENTS OF RAIL VEHICLES

CROSS-REFERENCE TO RELATED APPLICATIONS

The present application claims the benefit of priority to International Patent Application No. PCT/EP2008/003954 filed 16 May 2008, which further claims the benefit of priority to German Patent Application No. 10 2007 024 065.3 filed 22 May 2007, the contents of which are incorporated herein by reference in their entirety.

BACKGROUND

The invention is based on a device and a method for monitoring undercarriage components of rail vehicles for faults.

The monitoring systems for undercarriages are becoming increasingly important in rail vehicle transportation. On the one hand, for safety reasons, these monitoring systems are required normatively and in guidelines. Examples of this are the following systems which are required throughout Europe by the TSI (Technical Specification for Interoperability—Official Journal of the European Community) for high speed trains:

- On-board systems for detecting derailing,
- On-board systems for hot box detection and/or for detecting damage to bearings, and
- On-board systems for detecting instability and/or defective dampers.

On the other hand, the use of undercarriage monitoring systems for the diagnosis and early detection of damaged components, critical states and other faults in order to achieve early and status-oriented maintenance occurs. Objectives here are shorter downtimes, better utilization of components and therefore reduction of costs.

For example, in the ICE a system for detecting unstable running is used, and in relatively new automatic underground railway systems a system for detecting derailing is used. These systems have in common the fact that, in terms of function, they are constructed and act independently. Each of these systems uses dedicated sensors.

For instability detection, one or more sensors are usually mounted on the bogie frame, which sensors measure the lateral acceleration (in the transverse direction with respect to the direction of travel x) in a specific frequency range and generate an alarm message when their limiting values are exceeded.

DE 101 45 433 C2 and EP 1 317 369 describe a method and a device for monitoring components of a rail vehicle for faults, which method and device are also based on the measurement of acceleration values and are mounted on lateral damper brackets attached to the wagon body. The detection direction of the acceleration pickup is parallel to the direction of travel there.

An example of a method and a device for detecting derailing is described in DE 199 53 677. Here, measurement signals of an acceleration sensor which is arranged on an axle bearing are evaluated directly. The measured acceleration values are integrated twice and compared with a limiting value. The simple acceleration sensor has a detection direction extending in the direction of the vertical axis (z direction) of the rail vehicle. However, according to the document, acceleration sensors which simultaneously have detection directions in the direction of travel (x direction), in the transverse direction with respect to the direction of travel (y direction) and in the direction of the vertical axis (z direction) can also be used. Such an acceleration pickup is what is referred to as a multiple pickup, i.e. it is actually composed of at least two, here three acceleration pickups, each of which measures in one detection direction.

The problem with these safety-related monitoring devices is to ensure the functionality capability of the acceleration sensors which, depending on the safety level, cannot be guaranteed with a high degree of fail safety or detection of failures. FIG. 8 is a schematic view of the design and the function of a device for monitoring undercarriage components of rail vehicles for faults, which comprises the following:

- an acceleration sensor including attachment and integrated amplifier electronics and adaptation electronics,
- signal conditioning electronics and evaluation electronics including a supply device for the acceleration sensor,
- transmission lines for transmitting the signals of the acceleration sensor to the evaluation electronics, and
- transmission lines for supplying power to the acceleration sensor.

The functional capability of many components of the measurement chain shown in FIG. 8 can be tested during operation by means of test functions or circuits. It is therefore possible, for example, to detect a break in the transmission line by feeding in an offset voltage (medium voltage) or feeding a constant current to the acceleration sensor. A break in the line can then be detected from a change in the offset voltage or in the constant current.

On the other hand, testing the acceleration sensors themselves is problematic. In order to detect that the acceleration sensor is still functioning and is supplying a measurement signal precisely according to its specification, it is necessary to apply a defined acceleration signal to it. For this purpose, the acceleration sensor has to be dismounted and then mounted on a calibrated test bench (shaker), which constitutes a large amount of expenditure against the backdrop that acceleration sensors are often arranged in installation spaces which are difficult to access, such as bogies of rail vehicles. Furthermore, during the dismounting and remounting it is not possible to exclude the possibility of damage occurring to the sensor or of incorrect mounting occurring.

Another possibility is provided by sensors with a dedicated self testing device. In such sensors, the sensor element is excited by an additional integrated device. If the sensor supplies an anticipated signal it is intact. Such self testing devices are used, for example, in airbag sensors in motor vehicles. However, such a self testing device is not available for every type of sensor or every size of sensor and makes the sensor more expensive.

In order to avoid sensor tests on disinstalled sensors or self testing devices it is possible to provide acceleration sensors redundantly and to detect a failure or a malfunction of a sensor by comparing the two sensor signals for plausibility. However, this also requires a relatively high degree of technical expenditure and therefore increases costs.

SUMMARY

In contrast with the above, the invention provides a device and a method for monitoring undercarriage components of rail vehicles for faults, in such a way that the function of the acceleration sensors used can be monitored cost-effectively, while their design is simple.

In the device according to the invention, the acceleration sensor is embodied in such a way that it supplies a measurement signal which contains a signal component which corresponds to the acceleration g due to gravity, or constitutes a signal which corresponds to the acceleration g due to gravity. Furthermore, the evaluation device comprises a routine for checking the functioning of the acceleration sensor which routine modulates a fault signal if the measurement signal which is supplied by the acceleration sensor does not contain a signal component which corresponds to the acceleration g due to gravity or does not constitute a signal which corresponds to the acceleration g due to gravity and suppresses the fault signal if this is not the case.

Consequently, according to the method according to the invention, at least one acceleration sensor is used whose measurement signal contains a signal component which corresponds to the acceleration g due to gravity or constitutes a signal which corresponds to the acceleration g due to gravity. This acceleration sensor is arranged on the undercarriage of the rail vehicle in such a way that its detection direction has at least one component parallel to the vertical axis (z direction) of the rail vehicle, in which component the acceleration g due to gravity acts. Finally, the function of the acceleration sensor is checked in such a way that a fault signal is modulated if the measurement signal which is supplied by the acceleration sensor does not contain a signal component which corresponds to the acceleration g due to gravity or does not constitute a signal which corresponds to the acceleration g due to gravity and suppression of the fault signal if this is not the case.

The conditions "does not contain a signal component which corresponds to the acceleration g due to gravity" or "does not constitute a signal which corresponds to the acceleration g due to gravity" include cases in which there is a signal component or a signal which originates from the acceleration due to gravity but whose absolute value or value does not correspond to the absolute value or value which would be anticipated owing to the acceleration g due to gravity, consequently that is to say cases in which the measured value for the acceleration due to gravity is too large or too small compared to the real value. This is because such a measurement error indicates a fault in the acceleration sensor.

Compared to the prior art, the testing of the device according to the invention does not require any additional hardware or disinstallation of the acceleration sensors. Instead, the acceleration sensor which is to be checked supplies itself, within the scope of the measurement process according to the regulations, the information about its functional capability. The only requirement made of the acceleration sensor to be monitored is that it generates a measurement signal which, in the case of the traveling rail vehicle, includes the acceleration g due to gravity which is continuously acting on it, or in the case of the stationary rail vehicle constitutes the acceleration g due to gravity which is continuously acting on it, and has a response threshold which is lower than the acceleration g due to gravity.

The signal which corresponds to the acceleration g due to gravity or the signal component which corresponds to said signal therefore forms a calibration signal and test signal for the acceleration sensor. The invention is particularly suitable for acceleration sensors which have a measurement range of the order of magnitude of the acceleration g due to gravity. In the case of detection of instability, the measurement takes place, for example, in a range from −2 g to +2 g with a response threshold of 0.8 g. Even if the calibration signal and test signal were to differ from the measurement signal by orders of magnitude, at least a basic test of the acceleration sensor is possible. This constitutes a considerable saving compared to the measures in the prior art.

As a result of the measures specified in the subclaims, advantageous developments and improvements of the invention disclosed in the dependent claims are possible.

The device particularly may comprise filter means which filter out the signal component, which corresponds to the acceleration g due to gravity, of the measurement signal which is supplied by the acceleration sensor.

According to one development, the evaluation device can be embodied in such a way that the test routine is run through once, repeatedly at time intervals or continuously.

The acceleration sensor may particularly be a piezoelectric, piezoresistive or capacitive acceleration sensor.

According to one potential measure, a common sensor system is used for various functions of the monitoring of undercarriage components of rail vehicles for faults, such as the functions of detection of instability and detection of derailing mentioned at the beginning. Depending on the inventive arrangement of the acceleration sensors, they can detect accelerations in the direction of the vertical axis of the rail vehicle (z direction) and in the transverse direction with respect to the direction of travel (y direction) or in the direction of travel (x direction). Two variants may be provided here:

a) Arrangement of at least one acceleration sensor on a bogie frame or on a wheel set bearing of an axle of a bogie of the rail vehicle in such a way that its detection direction has a component in the direction of travel (x direction) or a component perpendicular to the direction of travel (y direction) and at the same time a component parallel to the vertical axis (z direction) of the rail vehicle, b) Provision of acceleration sensors which are assigned to wheel set bearings of one axle, one acceleration sensor of which is arranged on the one wheel set bearing of the axle in such a way that its detection direction is parallel to the direction of travel, and another acceleration sensor of which is arranged on the other wheel set bearing of the axle in such a way that its detection direction is parallel to the vertical axis of the rail vehicle.

In the variant a), a vectorial addition of the acceleration values in the z direction to those of the transverse acceleration or longitudinal acceleration (y and x directions) occurs owing to the oblique orientation of the detection direction of the acceleration sensor. The measured acceleration values are the sum of the vectorial individual accelerations in the z direction and y direction or in the z direction. These values already form a measure of the tendency of the undercarriage to have an unstable driving state or to be derailed. Selective monitoring can additionally be carried out by means of frequency-specific assessment of the measured acceleration values. The vibrations on the different spatial axes occur in different frequency bands. Therefore, in the case of unstable behavior there are tendentially lower frequencies in the transverse direction and longitudinal direction than in the vertical direction. In the case of derailing, a monitoring criterion is formed by the relatively high frequency components in the vertical axis. The selective evaluation of different frequency bands therefore permits selective monitoring for an unstable driving state and for derailing.

A component is continuously present in the specified directions (x, y and z directions) if the angle of the detection direction in the corresponding plane is within a range of 0 degrees to 90 degrees without, however, its limits including 0 degrees and 90 degrees. The angle of the detection direction may be particularly in a range from 10 to 80 degrees.

It is therefore possible in each case to sense, with just a single acceleration sensor, two detection directions which are perpendicular to one another (z direction and y direction or z direction and x direction). As a result, with just one acceleration sensor on the bogie or on an axle, definitive information about possible instability can be obtained by monitoring the transverse acceleration or longitudinal acceleration, and at the same time definitive information about a possible inclination to derail can be obtained by monitoring the acceleration in the direction of the vertical axis.

With just a single acceleration sensor per bogie, the expenditure for manufacturing, mounting and cabling of the acceleration sensor is minimal.

According to variant b), each wheel set bearing of an axle of a bogie is assigned an acceleration sensor. In this context, the detection directions of the two acceleration sensors which are assigned on both sides of an axle are respectively perpendicular to one another, specifically in the direction of travel (x direction) and in the direction of the vertical axis (z direction). As a result, by evaluating the acceleration signals of the acceleration sensors, the functions of detection of derailing and detection of instability can also be carried out. Because the acceleration sensors are assigned to the wheel set variants, axle bearing monitoring can also take place at the same time because excessive vibrations in the region of the wheel set bearings indicate defects in this region.

On the other axle of the bogie, the same arrangement may be implemented with inverted sides with respect to the detection directions. This results in each case in the same detection direction, viewed diagonally over the axles of the bogie. As a result, in each case two acceleration sensors with in each case the same detection direction and therefore redundancies for the respective detection direction are present per bogie.

In addition to the specified monitoring functions of detection and stability and detection of derailing, the device according to the invention can be used to implement further monitoring and diagnostic functions by means of suitable evaluation methods and corresponding evaluation electronics. When the sensor system is arranged on the bogie frame, it is therefore possible to monitor the components which are installed directly on the frame, such as the connecting rods, guide bushings and the frame itself.

In particular when the acceleration sensors are installed directly on the wheel set bearing or on the wheel set bearing housing, additional monitoring functions and diagnostic functions are conceivable such as, for example, the detection of flat points, the detection of bearing damage or even the detection of damage in the wheel set shaft and in or on the wheel itself.

According to variant a), the detection direction of the acceleration sensor may be particularly located in a plane perpendicular to an axle of the bogie, and has an angle of 45 degrees in relation to the vertical axis (z direction) and in relation to an axis (x direction) which is arranged parallel to the direction of travel. Because the components are then of equal size, balanced signals may be obtained for the longitudinal vibrations and vertical vibrations of the bogie or of the wheel set bearings. Alternatively, any desired angles within an angular range from 0 degrees to 90 degrees are, of course, possible.

Alternatively, the detection direction of the acceleration sensor can be located in a plane perpendicular to the direction of travel and can have an angle of 45 degrees in relation to the vertical axis (z direction) and in relation to an axis (y direction) which is arranged perpendicular to the direction of travel. In this case, balanced signals are obtained for the transverse vibrations and vertical vibrations of the bogie or of the wheel set bearings.

According to one development of variant a), in each case an acceleration sensor is particularly arranged on just one wheel set bearing of the two wheel set bearings of an axle. If the detection direction of this acceleration sensor is located in a plane perpendicular to the axis and may assume an angle of 45 degrees in relation to the vertical axis and in relation to an axis which is arranged parallel to the direction of travel, it is also possible to obtain balanced definitive information about the tendency to derail and the stability behavior of the undercarriage on the basis of the measurement signal of the acceleration sensor. If, for example, two such acceleration sensors are arranged diagonally with respect to a vertical rotational axis of the bogie, a redundant measurement is additionally obtained. This increases the safety of the monitoring device.

In this variant, the acceleration sensor may be combined with a pulse generator. The use of integrated sensors which supply the signals for the electronic monitoring unit and additionally sense the axle rotational speeds, for example for anti-skidding protection, reduces further the expenditure on the sensor installation and on cabling.

In order to minimize the expenditure on manufacturing costs and mounting costs and on cabling, according to one development of variant b) just a single acceleration sensor is provided per wheel set bearing of one axle. These acceleration sensors may be arranged on the wheel set bearings of the axles of the bogie in such a way that, viewed in the direction of travel, the detection directions of the acceleration sensors alternate on each side of the vehicle. Consequently, acceleration sensors with the same detection direction are arranged diagonally with respect to the vertical rotational axis of the bogie. This results in advantageous redundancy, which increases the fail safety of the monitoring device.

In this variant, at least one acceleration sensor may also be combined with a pulse generator, which provides the advantages already mentioned above. In addition, a temperature sensor for measuring the instantaneous bearing temperature in a wheel set bearing can also be integrated into the combination sensor. Reference is made to DE 10 2005 010 118 with respect to a possible design of such a combination sensor.

Last but not least, at least one electronic evaluation unit of the device for monitoring undercarriage components for faults can be an integral component of an anti-skid and/or brake control system of the rail vehicle, as is described in DE 10 2005 010 118.

The measures described above consequently result in a low degree of expenditure on mounting for the acceleration sensors, some of which have a detection direction with a component parallel to the vertical axis (z direction) of the rail vehicle. For these cases, in combination with the features of patent claim 1 a device for monitoring undercarriage components of rail vehicles for faults is obtained with an advantageously low number of acceleration sensors and evaluation devices owing to the specific arrangement of the acceleration sensors, which are, furthermore, also easy to monitor by virtue of the targeted selection of the type of sensor and the provision of special evaluation software, without them having to be disinstalled for this purpose or provided with additional hardware. Consequently, overall a device for monitoring undercarriage components of rail vehicles for faults is obtained which is very cost-effective and easy to check.

More precise details will be found in the following description of exemplary embodiments.

BRIEF DESCRIPTION OF THE FIGURES

Exemplary embodiments of the invention are presented below in the figures and explained in more detail in the following description. In the figures.

DESCRIPTION OF THE EXEMPLARY EMBODIMENTS

Figure 1:
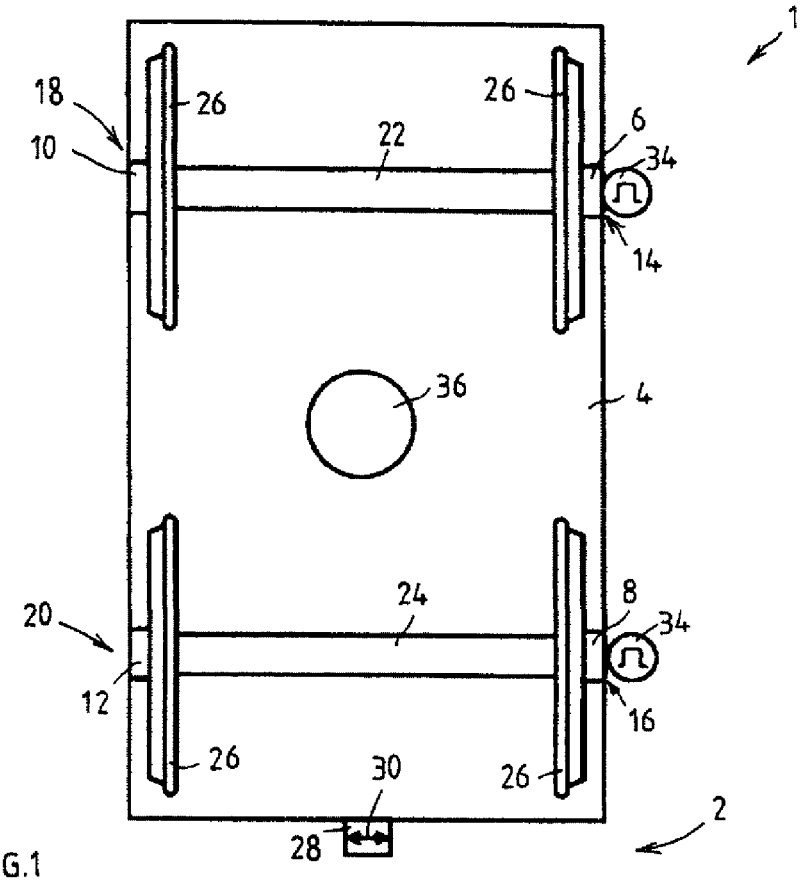
FIG. 1 shows a schematic plan view of a bogie with part of a device for monitoring undercarriage components of rail vehicles for faults, according to a first embodiment of the invention.

FIG. 1 illustrates a schematic plan view of a bogie 1 with a part of a device 2 for monitoring undercarriage components of rail vehicles for faults, according to a first embodiment of the invention.

The bogie 1 is arranged such that it can rotate about a vertical rotational axis 36 with respect to a wagon body (not illustrated), and said bogie 1 contains a bogie frame 4 which is supported on a wagon body of the rail vehicle by means of a secondary suspension system, which is likewise not shown because it is unimportant for the invention.

The bogie frame 4 is supported, on the other hand, by means of a primary suspension system on four wheel set bearing housings 6, 8, 10, 12, in each of which a wheel set bearing 14, 16, 18 and 20 for supporting an axle 22, 24 is accommodated, which axle 22, 24 has two wheels 26 at the ends. Overall, two axles 22, 24 are present per bogie 1.

Figure 2:
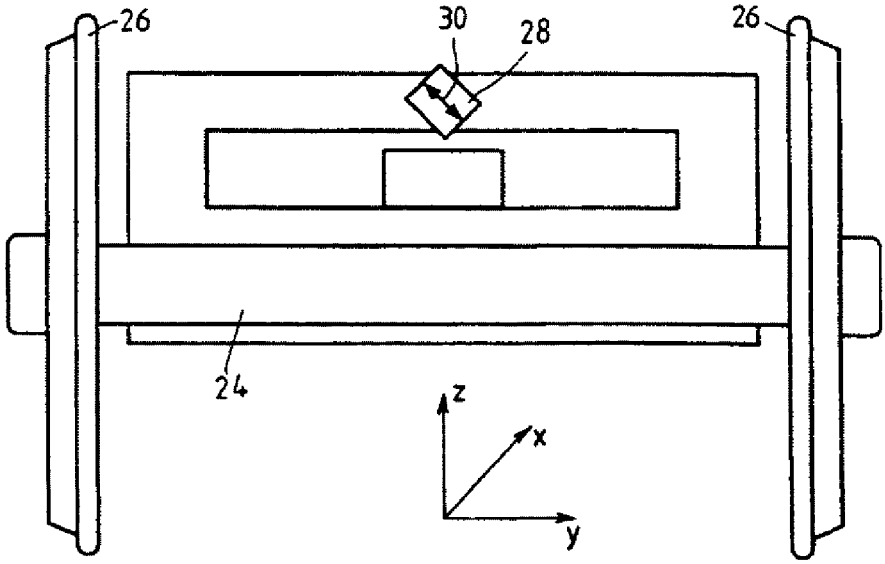
FIG. 2 shows a schematic end view of the bogie from FIG. 1.

In order to monitor the bogie 1 and its components 4 to 20, the device 2 for monitoring faults is provided, of which only a vibration pickup 28 can be seen in FIGS. 1 and 2.

The vibration pickup 28 is arranged on the bogie frame 4 of the bogie in such a way that its detection direction (symbolized by an arrow 30) has a component parallel to the vertical axis (z direction) and a component in the direction of travel (x direction) or a component perpendicular to the direction of travel (y direction) of the rail vehicle. The detection direction 30 of the vibration pickup 28, which is embodied, for example, as an acceleration sensor, may have a component perpendicular to the direction of travel (y direction) and at the same time a component parallel to the vertical axis (z direction) of the rail vehicle, as is apparent in particular from FIG. 2.

Then, owing to the oblique orientation of the detection direction 30 of the vibration pickup 28, a vectorial addition of the acceleration values in the z direction to those in the y direction (transverse acceleration) occurs. The resultant forms a measurement of the tendency of the bogie to derail (component of the z direction) and/or to assume unstable travel states such as excessive hunting (component of the y direction).

Furthermore, each axle 22, 24 is assigned a known pulse generator 34 for measuring the rotational speed, which pulse generator 34 may be arranged in the assigned wheel set bearing housing 6, 8 or is connected by flanges thereto by a suitable housing.

According to the embodiment in FIG. 1 and FIG. 2, the detection direction 30 of the vibration pickup 28 may be particularly located in a plane perpendicular to the direction of travel (x direction) and has an angle of, for example, 45 degrees in relation to the vertical axis (z direction) and in relation to an axis (y direction) which is arranged parallel to the direction of travel. Because the components in the direction of these axes are then of equal size, balanced signals may be produced for the transverse vibrations and vertical vibrations of the bogie 1.

Alternatively, the detection direction 30 of the vibration pickup 28 can be located in a plane perpendicular to an axle 22, 24 of the bogie and can have an angle of, for example, 45 degrees in relation to the vertical axis (z direction) and in relation to the direction of travel (x direction). In this case, balanced signals are obtained for the longitudinal and vertical vibrations of the bogie 1.

Figure 3:
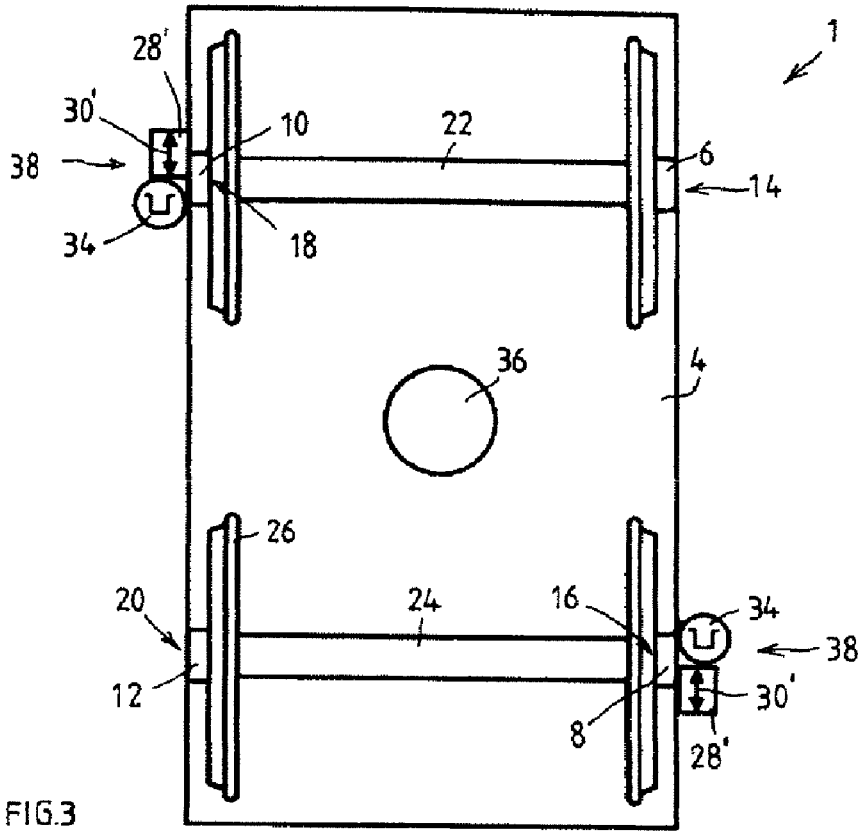
FIG. 3 shows a schematic plan view of a bogie with part of a device for monitoring undercarriage components of rail vehicles for faults, according to a further embodiment of the invention.
Figure 4:
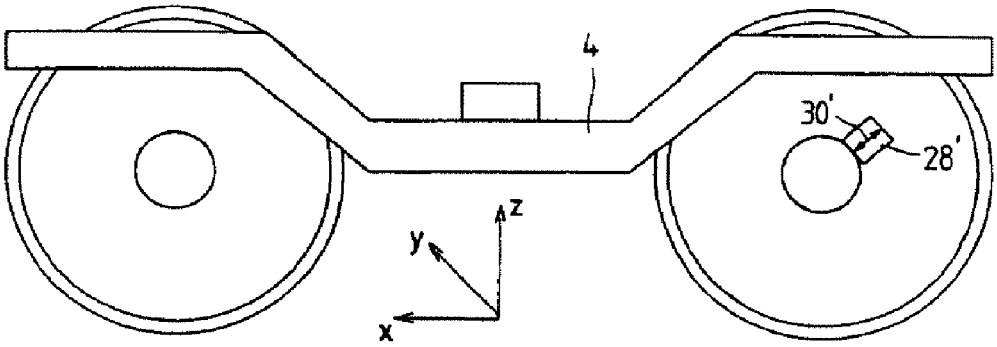
FIG. 4 shows a schematic side view of the bogie from FIG. 3.

According to the embodiment in FIG. 3 and FIG. 4, a vibration pickup 28' is arranged on, in each case, just one wheel set bearing 16, 18 of the two wheel set bearings 16 and 20 or 14 and 18 of an axle 22, 24. If the detection directions 30' of the two vibration pickups 28' are directed in the same way and are located in a plane perpendicular to the axles 22, 24 of the bogie 1 and, may have an angle of 45 degrees in relation to the vertical axis (z direction) and in relation to an axis (x direction) which is arranged parallel to the direction of travel, it is possible to obtain definitive balanced information about the tendency to derail and about the stability behavior of the undercarriage on the basis of the measurement signals of the vibration pickups 28'. The two vibration pickups 28' which are assigned to the axles 22, 24 may be particularly arranged, as shown in FIG. 3, diagonally with respect to the vertical rotational axis 36 of the bogie 1. In this embodiment, the vibration pickups 28' are additionally combined with, in each case, one pulse generator 34 for measuring the wheel speed in order to form an integrated combination sensor 38.

Figure 5:
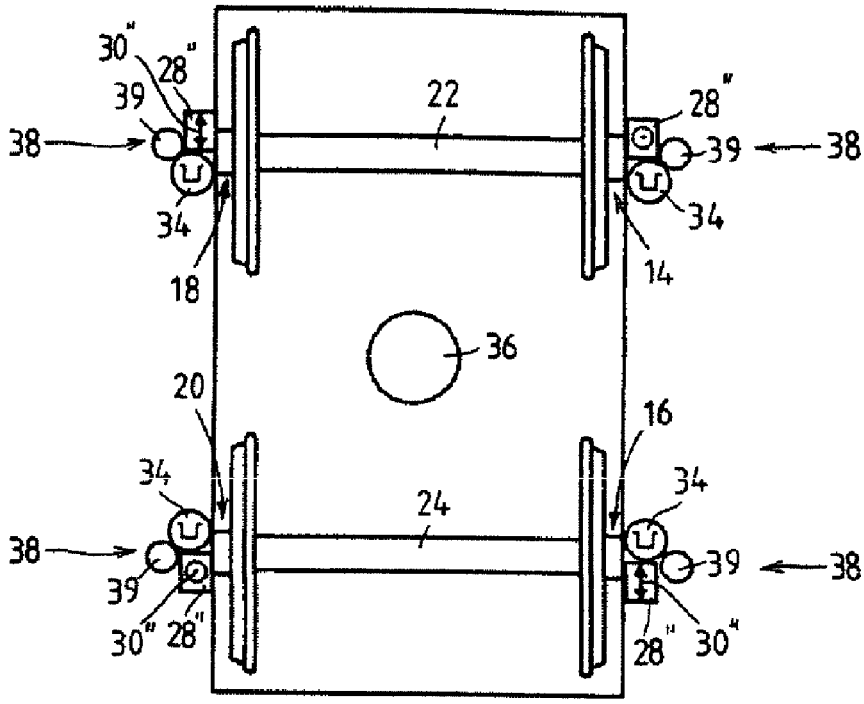
FIG. 5 shows a schematic plan view of a bogie with part of a device for monitoring undercarriage components of rail vehicles for faults, according to a further embodiment of the invention.
Figure 6:
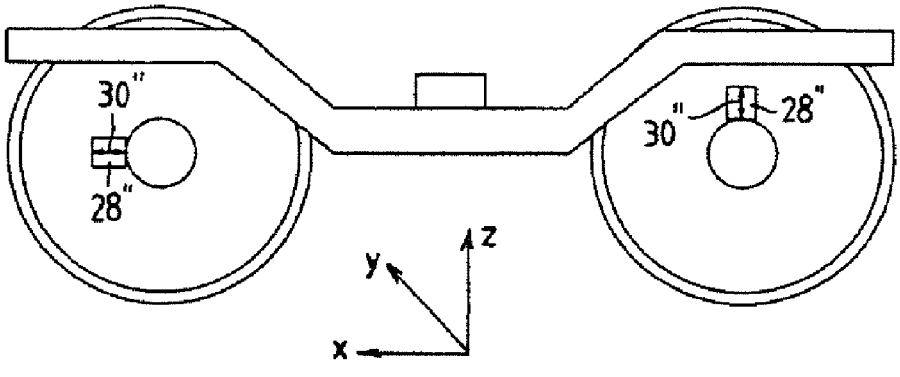
FIG. 6 shows a schematic side view of the bogie from FIG. 5.

In the embodiment in FIG. 5 and FIG. 6, each wheel set bearing 14 to 20 of the bogie 1 is assigned a vibration pickup 28", with the vibration pickup 28" being arranged on the one wheel set bearing 16 or 18 of the respective axle 24, 22 in such a way that its detection direction 30" is parallel to the direction of travel (x direction), and with the other vibration pickup 28' of which being arranged on the other wheel set bearing 14 or 20 of the respective axle 22, 24 in such a way that its detection direction 30" is parallel to the vertical axis (z direction) of the rail vehicle. Accordingly, the detection directions 30" of the two vibration pickups 28" which are assigned to the respective axle 22, 24 of the bogie 1 are each perpendicular to one another and point in the direction of travel (x direction) and in the direction of the vertical axis (z direction). Therefore, vibration pickups 28" with the same detection direction 30" may be arranged diagonally in relation to the rotational axis 36 of the bogie 1.

In this variant also, at least one vibration pickup 28" may be combined with a pulse generator 34 in a combination sensor 38, which provides the advantages already mentioned above. In addition, a temperature sensor 39 for measuring the instantaneous bearing temperature in the respective wheel set bearing 14 to 20 can also be integrated in the combination sensor 38.

In all the embodiments, only simple vibration pickups 28, 28', 28", i.e., which act in just one detection direction 30, 30' and 30", of the same type may be used.

Figure 7:
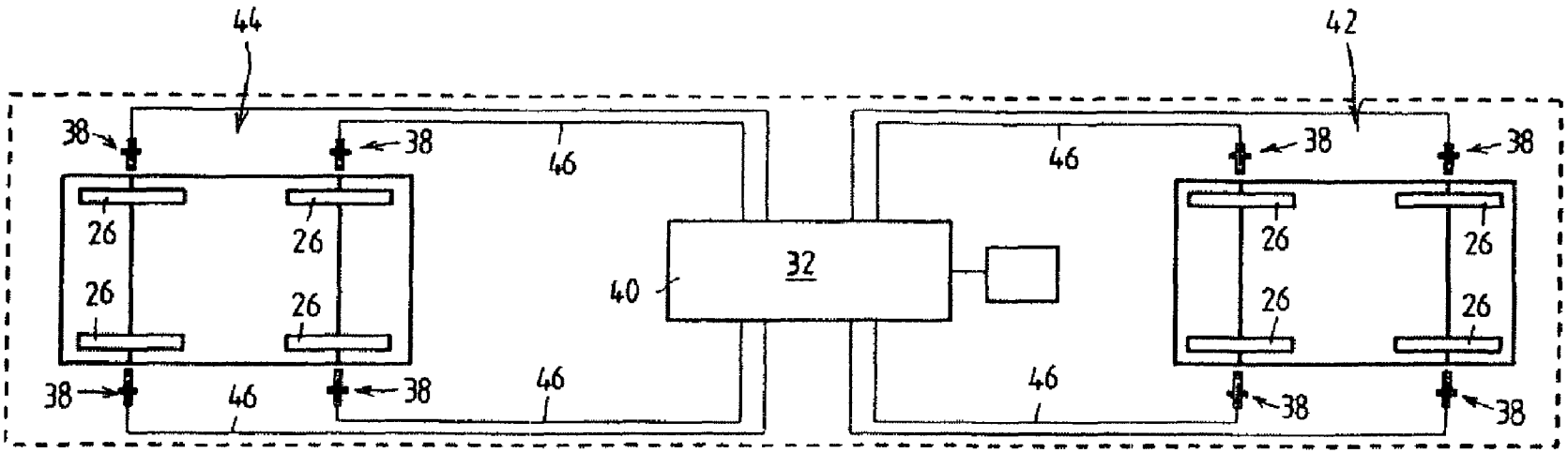
FIG. 7 shows a schematic circuit diagram of a device for monitoring undercarriage components of rail vehicles for faults, according to the embodiment from FIG. 5 and FIG. 6.
Figure 8:
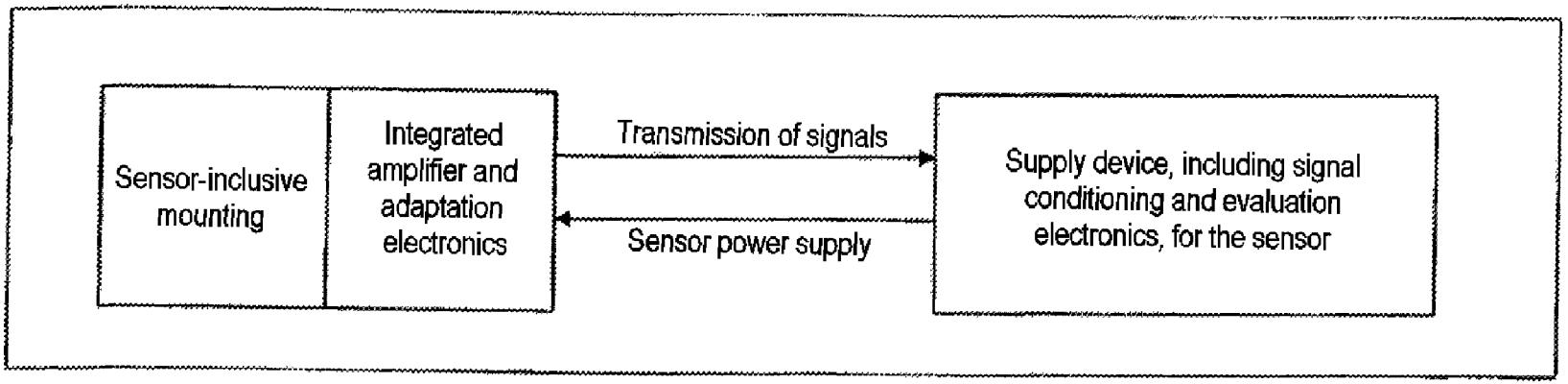
FIG. 8 shows a schematic illustration of a functional diagram of a device for monitoring undercarriage components of rail vehicles for faults.

FIG. 7 shows the evaluation electronics 32 of the device 2 integrated in the anti-skid electronics 40 of an anti-skid system for setting optimum slip between the wheels of a passenger car with two bogies 42, 44 and the rails for a velocity up to 200 km/h, which evaluation electronics 32 are connected with a signal-transmitting connection to the respective combination sensors 38 on the wheel set bearings via sensor lines 46. The passenger car may be equipped, per wheel set bearing, with a combination sensor 38 for measuring the wheel speed (pulse generator), the wheel bearing temperature (temperature sensor) and the wheel acceleration in the respective detection device 30" (simple acceleration pickup). The measurement signals of these sensors 38 are read into the central evaluation electronics 32 and evaluated there. Overall, the following monitoring functions can be implemented using the combination sensors 38:

Monitoring of rolling (detection of wheels which are not rotating)

Warm and hot box detection (monitoring of the temperature of the wheel set bearings), Detection of damage to bearings by measuring vibration, Detection of unstable running or of defective dampers in the undercarriage, Detection of derailing, and Detection of flat points and non-round wheels.

Furthermore, additional diagnostic functions for the early detection of defective components are possible. Last but not least, diagnosis of the rail line for damage to the track is also conceivable. Reading in or reading out or a display of data can then be carried out by means of an input/output device.

The acceleration sensors 28, 28', 28" which are described in the embodiments above and whose detection direction 30, 30', 30" has at least one component parallel to the vertical axis (z direction) of the rail vehicle, in which the acceleration g due to gravity acts, are embodied in such a way that they supply a measurement signal which contains a signal component which corresponds to the acceleration g due to gravity or constitutes a signal which corresponds to the acceleration g due to gravity. Furthermore, the evaluation electronics 32 comprise a routine for checking the functioning of the acceleration sensors 28, 28', 28", which routine modulates a fault signal if the measurement signal which is supplied by the respective acceleration sensor 28, 28', 28" does not contain a signal component which corresponds to the acceleration g due to gravity or does not constitute a signal which corresponds to the acceleration g due to gravity. In contrast, the fault signal is suppressed if this is not the case.

Consequently, in the described applications, acceleration sensors 28, 28', 28" are used whose measurement signal contains a signal component which corresponds to the acceleration g due to gravity or constitutes a signal which corresponds to the acceleration g due to gravity. Piezoelectric, piezoresistive or capacitive acceleration sensors 28, 28', 28" generally meet this condition. These acceleration sensors 28, 28', 28" are, as described, arranged on the undercarriage of the rail vehicle in such a way that their detection direction 30, 30', 30" has at least one component parallel to the vertical axis (z direction) of the rail vehicle, in which the acceleration g due to gravity acts.

Finally, the functioning of these acceleration sensors 28, 28', 28" is checked by modulating a fault signal if the measurement signal which is supplied by the respective acceleration sensor 28, 28', 28" does not contain a signal component which corresponds to the acceleration g due to gravity or does not constitute a signal which corresponds to the acceleration g due to gravity, and suppresses the fault signal if this is not the case. In this context, this test routine can be run once, repeatedly one after the other at time intervals or continuously.

The acceleration sensor 28, 28', 28" which is to be checked then itself supplies, within the scope of a measurement process according to the regulations, the information about its functional capability. The only requirement made of the monitoring acceleration sensor 28, 28', 28" is that it can generate a measurement signal which, in the case of the traveling rail vehicle, includes the static acceleration g due to gravity which acts on it continuously, or in the case of a stationary rail vehicle constitutes the static acceleration g due to gravity which is continuously acting on it, and has a response threshold which is smaller than the acceleration g due to gravity.

The device 2 particularly comprises filter means (not shown) which filter out the signal component, which corresponds to the acceleration g due to gravity, of the measurement signal which is supplied by the acceleration sensor 28, 28', 28".

The invention claimed is:

1. A device for monitoring undercarriage components of rail vehicles for faults, the device comprising at least one acceleration sensor which interacts with an evaluation device, wherein the at least one acceleration sensor is arranged on the undercarriage of the rail vehicle in such a way that a detection direction has at least one component parallel to the vertical axis of the rail vehicle, wherein:

the acceleration sensor supplies a measurement signal which contains a signal component which corresponds to the acceleration due to gravity or constitutes a signal which corresponds to the acceleration due to gravity, wherein, the evaluation device comprises a routine for checking the function of the acceleration sensor, which routine modulates a fault signal if the measurement signal supplied by the acceleration sensor does not contain a signal component having a value corresponding to anticipated acceleration due to gravity or does not constitute a signal having a value that corresponds to the anticipated acceleration due to gravity, and wherein the routine suppresses the fault signal if the measurement signal supplied by the acceleration sensor contains the signal component corresponding to the anticipated acceleration due to gravity or constitutes the signal corresponding to the anticipated acceleration due to gravity.

2. The device of claim 1, wherein the measurement signal which is supplied by the acceleration sensor when the rail vehicle is stationary constitutes the signal which corresponds to the acceleration due to gravity, and the measurement signal which is supplied by the acceleration sensor when the rail vehicle is traveling contains the signal component which corresponds to the acceleration due to gravity.

3. The device of claim 2, wherein filter means are present which filter out the signal component, which corresponds to the acceleration due to gravity, of the measurement signal which is supplied by the acceleration sensor.

4. The device of claim 1, wherein the evaluation device is embodied in such a way that the test routine is run through once, repeatedly at time intervals or continuously.

5. The device of claim 1, wherein the acceleration sensor is a piezo electric, piezo resistive or capacitive acceleration sensor.

6. The device of claim 1, wherein a) at least one acceleration sensor is arranged on a bogie frame or on a wheel set bearing of an axle of a bogie of the rail vehicle in such a way that the detection direction has a component in the direction of travel (x axis direction) or a component perpendicular to the direction of travel (y axis direction) and at the same time a component parallel to the vertical axis of the rail vehicle, or in that b) acceleration sensors which are assigned to wheel set bearings of one axle are provided, one acceleration sensor of which is arranged on the one wheel set bearing of the axle in such a way that the detection direction is parallel to the direction of travel (x axis direction), and another acceleration sensor of which is arranged on the other wheel set bearing of the axle in such a way that the detection direction is parallel to the vertical axis of the rail vehicle.

7. The device of claim 6, wherein a single acceleration sensor is arranged on the bogie frame of the bogie.

8. The device of claim 7, wherein the detection direction of the acceleration sensor is located in a plane perpendicular to an axle of the bogie, and has an angle of 45 degrees in relation to the vertical axis and in relation to the x axis direction which is arranged parallel to the direction of travel.

9. The device of claim 7, wherein the detection direction of the acceleration sensor is located in a plane perpendicular to the direction of travel (x axis direction) and has an angle of 45 degrees in relation to the vertical axis and in relation to the y axis direction which is arranged perpendicular to the direction of travel.

10. The device of claim 6, wherein, in each case, an acceleration sensor is arranged on just one wheel set bearing of the wheel set bearings of the axle of the bogie.

11. The device of claim 10, wherein the detection direction of the vibration pickup is located in a plane perpendicular to the axle and has an angle of 45 degrees in relation to the vertical axis and in relation to the x axis direction which is arranged parallel to the direction of travel.

12. The device of claim 6, wherein the acceleration sensor is provided for each wheel set bearing of an axle.

13. The device of claim 7, wherein the acceleration sensors are arranged on the wheel set bearings of the axles of the bogie in such a way that, viewed in the direction of travel, the detection directions of the vibration pickups on each side of the vehicle alternate with one another.

14. The device of claim 1, wherein at least one acceleration sensor is integrated, together with at least one speed sensor for measuring the instantaneous wheel speed and/or with a temperature sensor for measuring the instantaneous bearing temperature of a wheel set bearing, in a combination sensor.

15. A method for monitoring undercarriage components of rail vehicles for faults, said method comprising:

using at least one acceleration sensor to provide a measurement signal that contains a signal component which corresponds to the acceleration due to gravity or constitutes a signal which corresponds to the acceleration due to gravity, arranging of the acceleration sensor on the undercarriage of the rail vehicle in such a way that its detection direction has at least one component parallel to a vertical axis of the rail vehicle, checking of the function of the acceleration sensor in such a way that a fault signal is modulated if the measurement signal supplied by the acceleration sensor does not contain a signal component having a value corresponding to an anticipated acceleration due to gravity or does not constitute a signal having a value that corresponds to the anticipated acceleration due to gravity, and suppressing of the fault signal if the measurement signal supplied by the acceleration sensor contains the signal component corresponding to the anticipated acceleration due to gravity or constitutes the signal corresponding to the anticipated acceleration due to gravity.

* * * * *